US006019234A

United States Patent [19]

Chang

[11] Patent Number: 6,019,234

[45] Date of Patent: Feb. 1, 2000

[54] BRACKET FOR POSITIONING BOOKS

[76] Inventor: Chia-Sung Chang, No. 13, Lane 1, Sec.1, Chung-Shan Rd., Da-Tsuen Country, Chang-hua County, Taiwan

[21] Appl. No.: 09/111,714

[22] Filed: Jul. 8, 1998

[51] Int. Cl.[7] ..... A47F 5/00

[52] U.S. Cl. ..... 211/184

[58] Field of Search ..... 211/43, 41.12, 211/45, 184; 108/60, 61

[56] References Cited

U.S. PATENT DOCUMENTS 1,613,447 1/1927 Ellberg .

*Primary Examiner*—Alvin Chin-Shue
*Assistant Examiner*—Sarah Purol
*Attorney, Agent, or Firm*—Bacon & Thomas, PLLC

[57] ABSTRACT

A positioning bracket comprising a retaining section and a connecting section that is connected to the retaining section by means of a shoulder is provided. The connecting section is formed with at least two elongate openings along the longitudinal direction of the connecting section. The retaining section is provided with at least two through holes. At least a locking bolt is used to attach the retaining section to a board. A supporting rod is removably assembled to the elongate opening.

1 Claim, 3 Drawing Sheets

BRACKET FOR POSITIONING BOOKS

FIELD OF THE INVENTION

The present invention relates to a positioning bracket, and particularly to a positioning bracket for positioning a binder, book or the like.

DESCRIPTION OF THE PRIOR ART

The conventional wooden bookshelf used for storing books, files, and binders is only partitioned by at least a horizontal board that divides the bookshelf into at least two storing spaces for books and files. If these storing spaces are not completely filled, the books disposed therein may readily fall down. This is adverse for files management as a wanted file cannot be spotted.

SUMMARY OF THE INVENTION

It is the objective of this invention to provide a positioning bracket that can be conveniently attached to the storing space thereby dividing the storing space into at least two storing units and each book disposed therein can be firmly supported.

BRIEF DESCRIPTION OF THE DRAWINGS

In order that the present invention may more readily be understood the following description is given, merely by way of example with reference to the accompanying drawings, in which.

DETAILED DESCRIPTION OF THE PREFERRED EMBODIMENT

Figure 1:
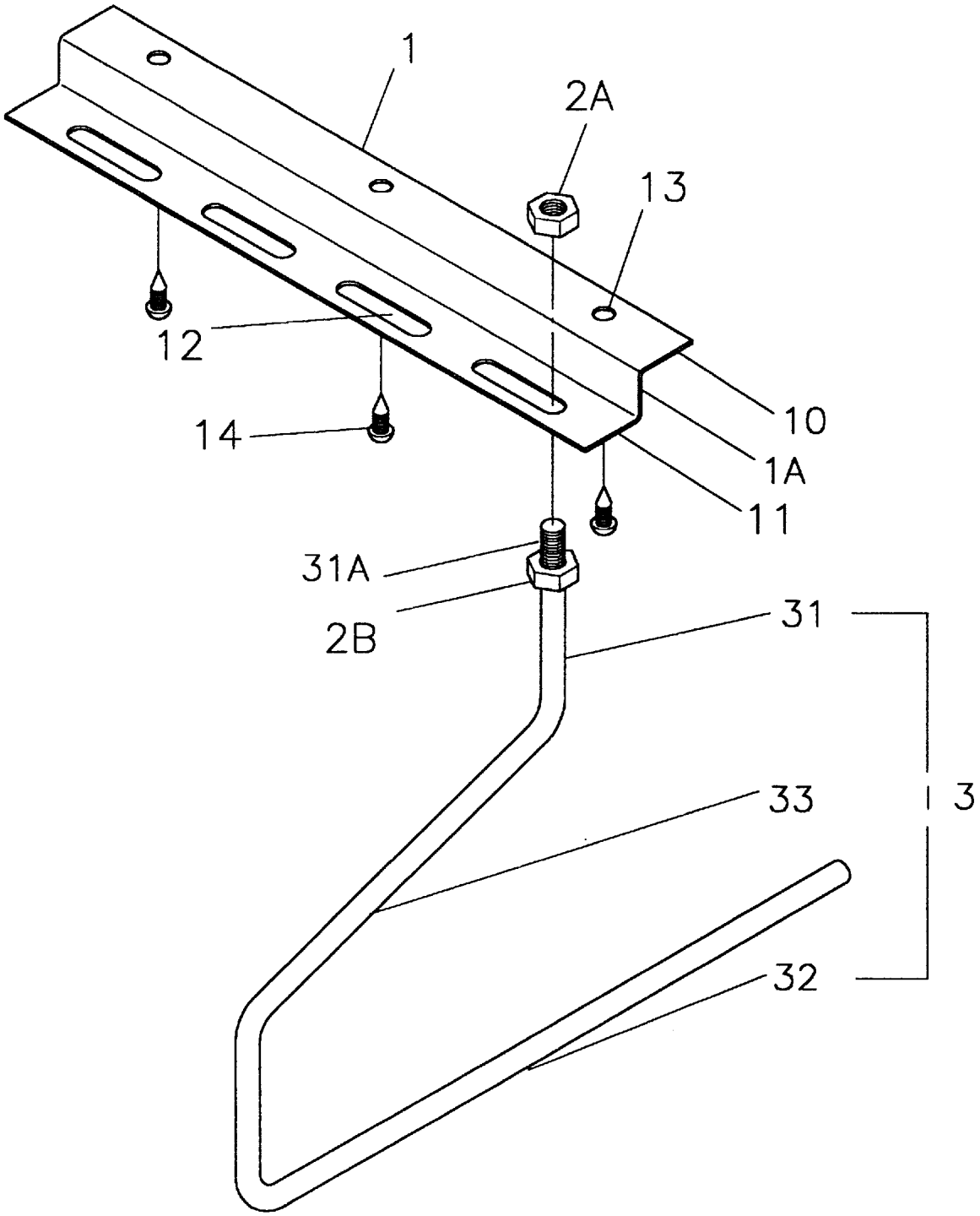
FIG. 1 is an exploded perspective view of the positioning bracket in accordance with the present invention.
Figure 2:
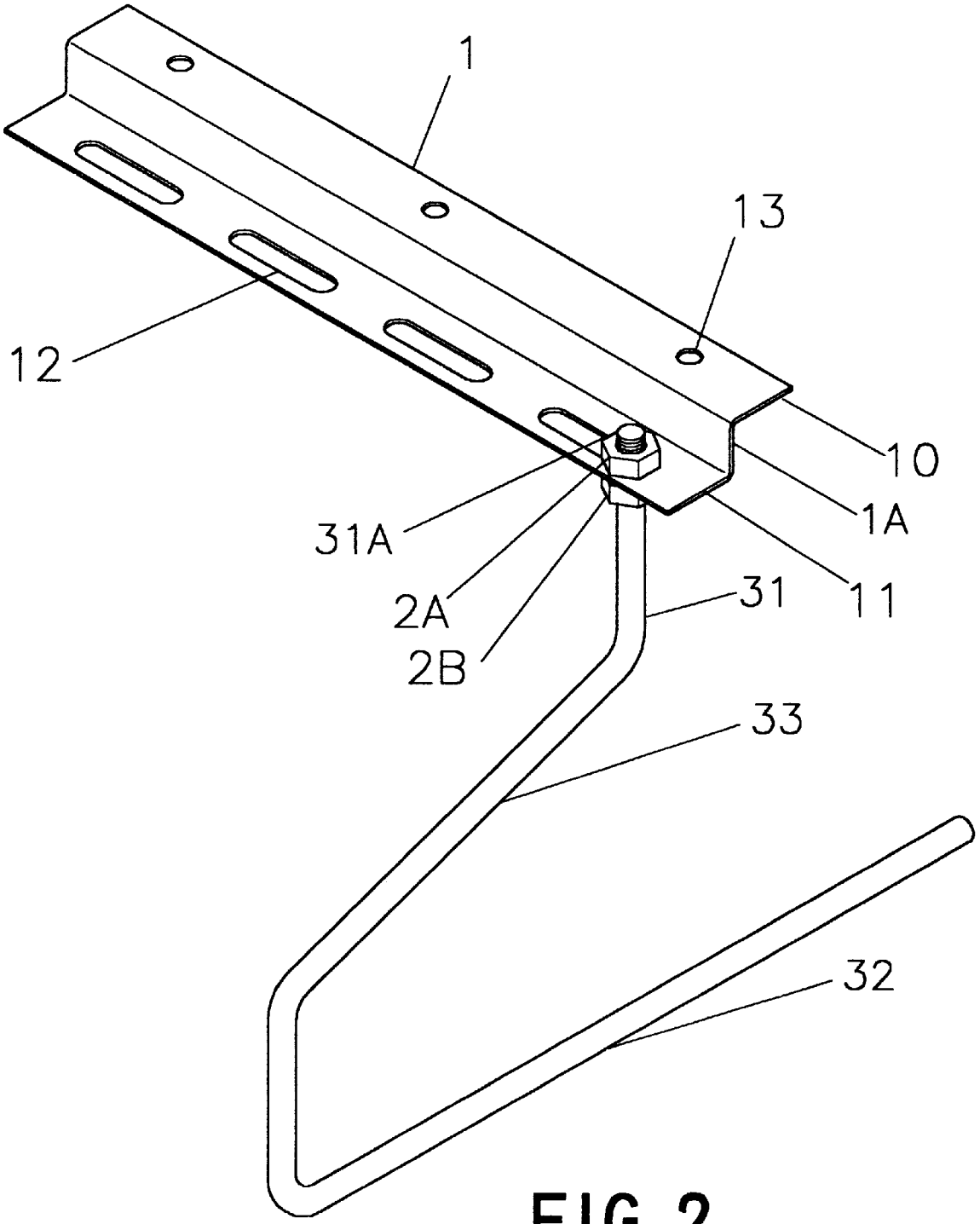
FIG. 2 is a perspective view of the assembled positioning bracket shown in FIG. 1.

Referring to FIG. 1, the positioning bracket 1 in accordance with the present invention comprises an elongate body having a retaining section 10 and a connecting section 11 connected together by means of a shoulder 1*a* such that the retaining section 10 is parallel to and spaced from the connecting section 11. The connecting section 11 is formed with at least two elongate openings 12 along the longitudinal direction of the connecting section 11. The retaining section 10 is also provided with at least two through holes 13 each spaced from one another. At least one pair of locking bolts 14 are used to attach the retaining section 10 to a board (not shown). The positioning bracket 1 further includes a supporting rod 3 forming an anchoring portion 31, supporting portion 32, and a joint portion 33 disposed between the anchoring portion 31 and the supporting portion 32. The anchoring portion 31 is provided with outer threads 31*a* for engagement by a pair of locking nuts 2A, 2B. The supporting rod 3 can be assembled to the elongate opening 12 by means of locking nuts 2A, 2B in a manner that the connecting section 11 is sandwiched between locking nuts 2A, 2B (as clearly shown in FIG. 2).

Figure 3:
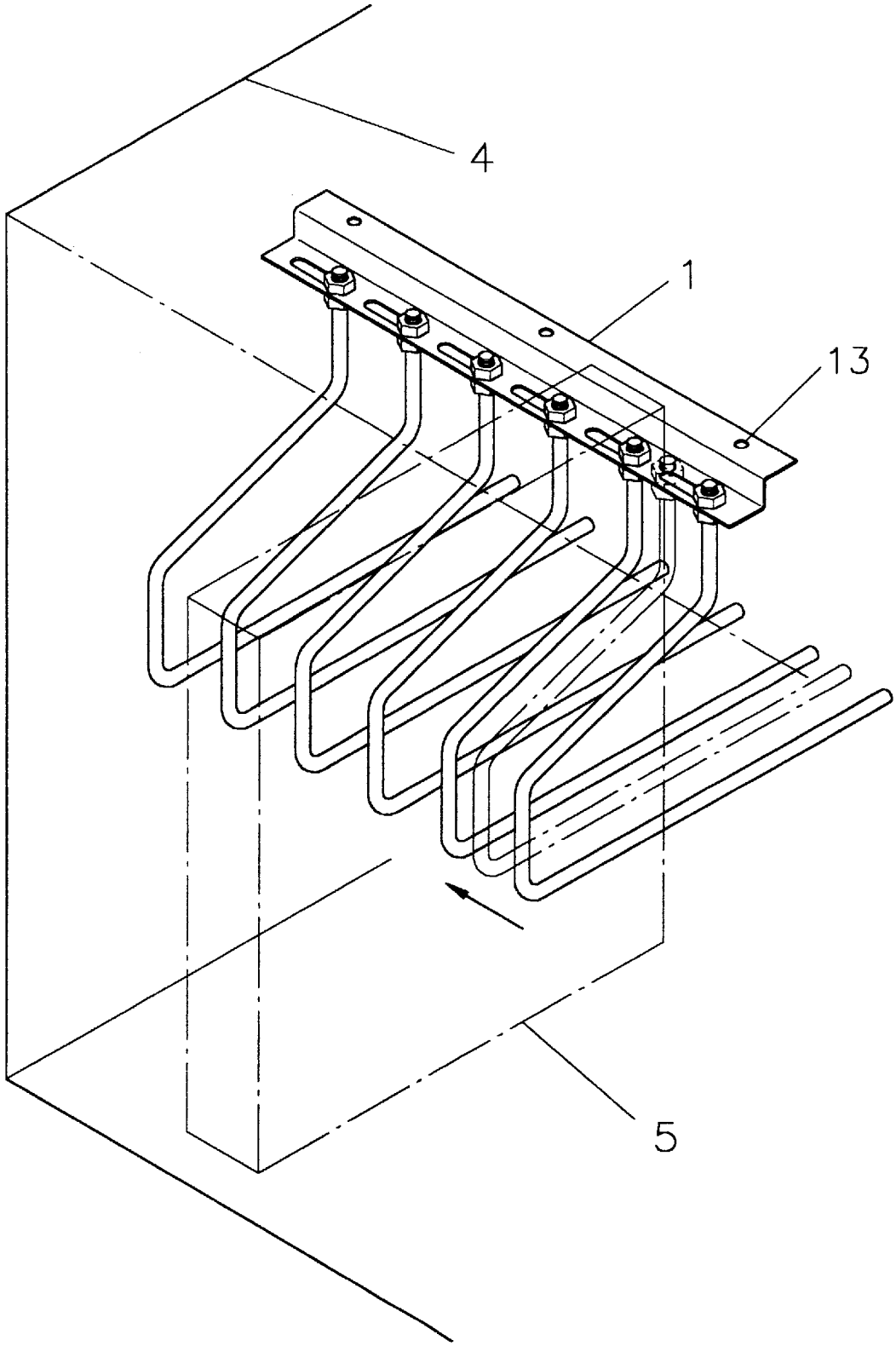
FIG. 3 is a schematic illustration of the positioning bracket attached in a bookshelf.

Referring to FIG. 3, the positioning bracket 1 is firstly assembled to a partitioning board (not labeled) by a plurality of locking bolts 14 that pass through the through holes 13. After the retaining section 10 is firmly secured, a plurality of supporting rods 3 are each assembled to a corresponding elongate opening 12 by means of a pair of locking nuts 2A, 2B. By this arrangement, a small storing unit is arranged between two adjacent supporting rods 3. As a result, the book or file/binder can be disposed between two adjacent supporting rods 3.

On the other hand, the supporting rod 3 can be readily moved along the elongate opening 12 to adjust the small storing space between two adjacent supporting rods 3. In light of this, the book with different thickness can be readily disposed therein.

Furthermore, the number of the supporting rods 3 can be conveniently increased or decreased according to the space of the bookshelf 4.

From the forgoing description, it can be readily appreciated that the books, binder and files can be readily disposed within a corresponding small storing space. This is really advantageous for file or book management. The specified book or file can be readily spotted as the entire bookshelf is well organized.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A bracket for positioning books comprising:

a) an elongate body including a shoulder section, a retaining section and a connecting section, the retaining section being spaced from and disposed in parallel to the connecting section;

b) the retaining section including at least one pair of spaced holes formed therethrough for receiving fasteners to secure the bracket to a board;

c) the connecting section including at least two spaced slots formed therethrough; and d) at least one support rod including an anchoring portion, a supporting portion and a joint portion, the joint portion being disposed between the anchoring and supporting portions, the anchoring portion having a threaded end for engagement through a selected slot, and a pair of locking nuts for removably securing the threaded end to the connecting section and permitting the support rod to be movably positioned along the slot.

* * * * *